US011051562B2

(12) United States Patent
Rundle

(10) Patent No.: US 11,051,562 B2
(45) **Date of Patent: *Jul. 6, 2021**

(54) RAIN GARMENT

(71) Applicant: Brella Brella LLC, Webster, NY (US)

(72) Inventor: Hugh J. Rundle, Webster, NY (US)

(73) Assignee: Brella Brella LLC, Rochester, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/117,539

(22) Filed: Aug. 30, 2018

(65) Prior Publication Data

US 2018/0368488 A1 Dec. 27, 2018

Related U.S. Application Data

(63) Continuation of application No. 15/656,617, filed on Jul. 21, 2017, now Pat. No. 10,080,391, which is a (Continued)

(51) Int. Cl.
*A41D 3/08* (2006.01)
*A41D 3/04* (2006.01)

(52) U.S. Cl.
CPC ..... *A41D 3/08* (2013.01); *A41D 3/04* (2013.01); *A41D 2200/20* (2013.01); *A41D 2300/32* (2013.01); *A41D 2600/10* (2013.01)

(58) Field of Classification Search
CPC ..... A41D 3/08; A41D 3/04; A41D 2200/20; A41D 2300/32; A41D 2600/10; A41B 13/06

(Continued)

(56) References Cited

U.S. PATENT DOCUMENTS 1,099,031 A 6/1914 Fligel
1,374,301 A 4/1921 Howard (Continued)

FOREIGN PATENT DOCUMENTS

DE 202014005760 U1 8/2014
JP 2001-192910 A 7/2001

(Continued)

OTHER PUBLICATIONS

Martone Cycling Co. Raincape by Cleverhood. LuxeMode <http://www.luxemode.fr/objet/1413802.html> Mar. 9, 2014.

(Continued)

*Primary Examiner* — Alissa L Hoey
(74) *Attorney, Agent, or Firm* — Brian B. Shaw, Esq.; Harter Secrest & Emery LLP

(57) ABSTRACT

A garment in a preferred embodiment includes front, rear and first and second side panels and a hood all formed from a single piece of a high performance, water-proof, breathable material. The user may use releasable fasteners affixed above fixed connection points along each opposite side of the front and rear panels to adjust the size of the sleeve openings. Releasable fasteners are provided below the fixed connection points to allow the user to open or close the side edges of the front and rear panels below the fixed connection points. A plurality of releasable fasteners is provided along the bottom edges of the front and rear panels to allow the user to selectively adjust the fit about the user's torso.

20 Claims, 9 Drawing Sheets

Related U.S. Application Data continuation-in-part of application No. 15/283,823, filed on Oct. 3, 2016, now abandoned.

(58) Field of Classification Search
USPC ..... 2/84, 88, 114
See application file for complete search history.

(56) References Cited

U.S. PATENT DOCUMENTS

| | | | | |
|---|---|---|---|---|
| 1,509,296 | A | 9/1924 | Hopewell | |
| 1,556,390 | A | 10/1925 | Woodley | |
| 1,993,149 | A | 3/1935 | Desmond | |
| 2,051,437 | A | 8/1936 | Dorn | |
| 2,103,608 | A | 12/1937 | Blauer | |
| 2,144,875 | A | 1/1939 | Forrest | |
| 2,334,061 | A | 11/1943 | Berkman | |
| 2,452,475 | A | 10/1948 | Kraft et al. | |
| 2,500,982 | A | 3/1950 | Fligel | |
| 2,547,931 | A | 4/1951 | De Grazia | |
| 2,711,538 | A | 6/1955 | De Cordero | |
| D182,645 | S | 4/1958 | Cetrulo | |
| 2,967,306 | A | 1/1961 | Fabanich | |
| 3,144,660 | A | 8/1964 | Portaro | |
| 3,665,518 | A | 5/1972 | Leadford | |
| 3,742,519 | A | 7/1973 | Wiley | |
| 3,946,443 | A | 3/1976 | Knight | |
| 3,968,803 | A | 7/1976 | Hyman | |
| 4,064,562 | A | 12/1977 | Kenny | |
| 4,078,264 | A | 3/1978 | DeGennaro et al. | |
| 4,118,802 | A | 10/1978 | Polster | |
| 4,142,254 | A | 3/1979 | Arnold | |
| 4,301,547 | A | 11/1981 | Bloise | |
| 4,313,229 | A | 2/1982 | Villafane | |
| 4,370,755 | A | 6/1983 | Crumby | |
| 4,390,096 | A | 6/1983 | Goldenberg | |
| 4,484,362 | A | 11/1984 | Asher | |
| 4,554,682 | A | 11/1985 | Hillquist | |
| 4,706,304 | A | 11/1987 | Jones | |
| 4,752,971 | A | 6/1988 | Meserol | |
| 4,825,469 | A | 5/1989 | Kincheloe | |
| 4,866,790 | A | 9/1989 | Ross, Jr. | |
| 5,077,838 | A | 1/1992 | Senser | |
| 5,091,993 | A | 3/1992 | Merrill et al. | |
| 5,099,526 | A | 3/1992 | Baena | |
| 5,168,579 | A | 12/1992 | Marshall | |
| 5,452,476 | A | 9/1995 | Jenks | |
| 5,564,125 | A | 10/1996 | Waldman et al. | |
| 5,664,258 | A | 9/1997 | Harris | |
| 5,697,102 | A | 12/1997 | Benjamin | |
| 5,855,021 | A | 1/1999 | Somerville | |
| 5,887,279 | A * | 3/1999 | Elting | A41D 13/1263 2/114 |
| 5,991,923 | A | 11/1999 | Maria | |
| 6,014,772 | A | 1/2000 | Connelly | |
| D429,059 | S | 8/2000 | Simmons | |
| D430,721 | S | 9/2000 | Beauchan | |
| 6,185,743 | B1 | 2/2001 | Mick | |
| 6,296,618 | B1 | 10/2001 | Gaber | |
| 6,327,711 | B1 | 12/2001 | Fujiwara | |
| 6,353,933 | B1 | 3/2002 | Love | |
| 6,360,370 | B1 | 3/2002 | Ferras | |
| D456,114 | S | 4/2002 | Pyle et al. | |
| 6,454,125 | B1 | 9/2002 | Rink, Jr. | |
| 6,508,684 | B2 | 1/2003 | Cotten | |
| D472,694 | S | 4/2003 | Pyle et al. | |
| D478,708 | S | 8/2003 | Miros et al. | |
| 6,649,251 | B1 | 11/2003 | Druecke et al. | |
| 6,694,521 | B1 | 2/2004 | Hopkins | |
| 6,708,343 | B1 | 3/2004 | Ceron | |
| 6,742,191 | B2 | 6/2004 | Yang | |
| 6,859,942 | B1 | 3/2005 | Cratty | |
| 7,047,569 | B1 | 5/2006 | Mahon et al. | |
| 7,111,328 | B2 * | 9/2006 | Bay | A41D 3/00 2/86 |
| 7,178,185 | B1 | 2/2007 | Nattler | |
| 7,222,371 | B2 | 5/2007 | Houghton et al. | |
| D560,881 | S | 2/2008 | D'Acquisto | |
| D600,884 | S | 9/2009 | Patton | |
| 7,694,350 | B2 * | 4/2010 | Hodges | A41D 1/215 2/114 |
| 7,765,611 | B2 | 8/2010 | Marshall et al. | |
| D638,612 | S | 5/2011 | Benderradji | |
| D672,534 | S | 12/2012 | Smith | |
| D677,859 | S | 3/2013 | Andes | |
| D679,484 | S | 4/2013 | Brown | |
| D683,523 | S | 6/2013 | Freedman | |
| D684,341 | S | 6/2013 | Freedman | |
| D713,126 | S | 9/2014 | Franz | |
| 8,832,864 | B1 * | 9/2014 | Braden | A41D 13/1272 2/114 |
| D714,524 | S | 10/2014 | Borovicka | |
| D722,421 | S | 2/2015 | Jackson | |
| D732,799 | S | 6/2015 | Smith | |
| 9,420,833 | B2 | 8/2016 | Jenkins | |
| D854,787 | S | 7/2019 | Ngan | |
| D877,461 | S | 3/2020 | Mieszczak | |
| D894,536 | S | 9/2020 | Ngan | |
| 2004/0000332 | A1 | 1/2004 | Yang | |
| 2004/0237167 | A1 | 12/2004 | Curry | |
| 2006/0010555 | A1 | 1/2006 | Hayes et al. | |
| 2006/0288465 | A1 | 12/2006 | Delorenzo et al. | |
| 2007/0074329 | A1 | 4/2007 | Marshall et al. | |
| 2007/0250982 | A1 | 11/2007 | Norman | |
| 2008/0066229 | A1 * | 3/2008 | Auer | A41D 3/08 5/482 |
| 2009/0025119 | A1 * | 1/2009 | Nespor | A41D 7/008 2/84 |
| 2009/0031473 | A1 | 2/2009 | Hartfield | |
| 2009/0070913 | A1 | 3/2009 | Park | |
| 2010/0064412 | A1 | 3/2010 | Slutzky | |
| 2010/0146680 | A1 * | 6/2010 | Cuoco | A41D 3/08 2/84 |
| 2011/0010819 | A1 * | 1/2011 | McGrath | A41D 13/1245 2/114 |
| 2011/0179548 | A1 | 7/2011 | Weston | |
| 2011/0258749 | A1 | 10/2011 | Hibbs | |
| 2012/0144550 | A1 | 6/2012 | Nejad | |
| 2012/0291178 | A1 | 11/2012 | Fu | |
| 2013/0019378 | A1 | 1/2013 | White | |
| 2013/0042384 | A1 | 2/2013 | Mitchell et al. | |
| 2013/0212772 | A1 | 8/2013 | Apostoloff | |
| 2013/0269082 | A1 | 10/2013 | Bramblet | |
| 2013/0318679 | A1 | 12/2013 | Esquer | |
| 2014/0345029 | A1 | 11/2014 | Saladino | |
| 2015/0013043 | A1 | 1/2015 | Peters | |
| 2015/0052661 | A1 | 2/2015 | Poznick | |
| 2015/0189924 | A1 | 7/2015 | Desbrow | |
| 2015/0250240 | A1 | 9/2015 | Hunkele | |
| 2015/0267911 | A1 | 9/2015 | Cushnie | |
| 2015/0327612 | A1 * | 11/2015 | Bublitz | A41D 3/02 2/202 |
| 2016/0015099 | A1 | 1/2016 | Saladino | |
| 2018/0092410 | A1 | 4/2018 | Rundle | |
| 2019/0254410 | A1 * | 8/2019 | DuVall | A45F 4/14 |

FOREIGN PATENT DOCUMENTS

| | | | |
|---|---|---|---|
| JP | 2012219378 | A | 11/2012 |
| KR | 20-0237015 | Y1 | 10/2001 |
| KR | 20-2012-0004471 | U | 6/2012 |
| KR | 10-1394554 | B1 | 5/2014 |
| KR | 10-2016-0090001 | A | 7/2016 |

OTHER PUBLICATIONS

Korean Intellectual Property Office, International Search Report and Written Opinion of corresponding International Application No. PCT/US2018/042674, completed Feb. 15, 2019.

Poncho by adfabinidaho, posted to etsy. Available date: Sep. 12, 2016 [site visited Nov. 3, 2020] Available: <https://www.etsy.com/listing/246455163/poncho-nnens-poncho-hooded-poncho-hooded?ref=reviews> (Year: 2016).

(56) References Cited

OTHER PUBLICATIONS

Glastonbury Rain Gear by Russell James Smith, posted to commons.wikimedia.org. Date available: Jun. 25, 2009 [site visited Nov. 4, 2020] Available: <https://connnnons.wikinnedia.org/wiki/File:Glastonbury rain gear.jpg> (Year: 2009).
Fleece Poncho by Advanced Fabrication. Available date: Jul. 17, 2016 [site visited Nov. 3, 2020] Available: <https://www.facebook.com/adfabinidaho/? xts [0]=> (Year 2016).
CLC Rain Wear by Custom Leathercraft Store, posted to amazon.com. Available date: Feb. 25, 2009 [site visited Nov. 4, 2020] Available: <https://www.annazon.conn/Rain-Wear-R10440-10MM-Poncho/dp/B001SES1GC> (Year: 2009).

* cited by examiner

RAIN GARMENT

BACKGROUND OF THE INVENTION

The present invention relates to protective garments for inclement weather, and more particularly relates to a garment in the general form of a hooded rain garment that is especially designed to protect a golfer's upper body from getting wet in the rain. While the invention as described herein is primarily directed as being worn by a golfer, it is understood that the benefits of the invention may be realized by any user type (e.g., athlete, spectator, tourist, worker, etc.) in any environmental condition (e.g., snow, rain, wind, hail, fog, ultraviolet rays, etc.) and outdoor setting (e.g., work site, sports, travel, leisure, stadiums, etc.). The invention is therefore not to be construed as being limited to any particular environmental condition, outdoor setting or user type.

Rain protection garments have been in use for a very long time and come in a variety of designs and materials. Two of the most basic deigns for covering the upper body are the jacket, which includes sleeves, and the sleeveless poncho, each of which may include a hood to cover the head. Of course the main function provided by either garment is to keep the upper body dry and thus may be made from a variety of available water resistant materials. The rain protection garments available on today's market continue to suffer certain drawbacks, some of which include the poncho type being too long and bulky for a golf swing and not having sufficient coverage when the arms are raised, as during a golf swing, for example. While the sleeveless poncho allows unrestricted arm movement for the golfer, the typical poncho design is completely open along the bottom such that areas of the upper body are exposed when the arms are raised. Strong winds also result in the poncho rising up and flapping. As a result, the golfer may still get wet despite wearing the poncho. While the rain jacket provides good coverage, the rain jacket sleeves seriously restrict the golfer's arm movements which may lead to a bad golf swing.

Regarding a hooded poncho, should the hood be too small, the user's head will get wet. Should the hood be too large, it may obstruct the user's view, particular as the head is rotated during a golf swing.

Rain jackets and ponchos, particularly those made of water proof materials such as polyurethane with a nylon or polyester outer layer, for example, have also been known to cause overheating of the user leading to profuse sweating. Should the user become drenched in sweat, they are no longer dry, thus defeating the purpose of the rain protection garment. Overheating can also be dangerous to the health of the user in that the increase in body temperature can lead to heat stroke. Even further, should the user remove the poncho and still be covered in sweat, cold temperature and/or wind could cause the user's body temperature to suddenly drop and lead to hypothermia. Breathable, water-resistant fabrics are known but some may nonetheless oversaturate and "wet out" over extended periods of time in a driving rain.

There thus remains a need for a rain garment which overcomes the drawbacks of present day sleeveless rain ponchos and jackets discussed above.

SUMMARY OF THE INVENTION

The present invention addresses the above needs by providing a hooded rain garment which covers the upper torso including the head, neck, shoulders and all or a portion of the arms. The rain garment includes a front panel and a rear panel each including side edges. The front and rear panel side edges are each fixed together at a single point and include strategically placed cooperative releasable fasteners both above and below the fixed connection point. This allows the user to easily find the sleeve opening when donning the garment and then, if desired for a closer fit, selectively attach one or more of the releasable fasteners together to adjust the fit as desired. For example, connecting the releasable fasteners above the fixed connection point forms an upper sleeve which is more closely fit to the user's arm at this location which may be desired when walking, for example. When ready to swing the club or to simply increase ventilation, for example, the user may quickly unfasten the releasable fastener which will provide a very loose fit around the user's arm allowing them freedom of movement which is beneficial while executing the golf swing. Releasable fasteners located along the sides and below the fixed connection point provide further options to the user. When these releasable fasteners are unattached, the front and rear panel side edges are open (separated) below the fixed connection point, again increasing freedom of movement and ventilation whenever desired. Closing these releasable fasteners provides protective coverage along the sides.

Additional releasable fasteners are provided along the bottom edges of the front and rear panels. In a preferred embodiment, at least two but preferably four releasable fasteners are provided in spaced relation along the bottom edges beginning at the opposite corners of the side and bottom edges. The user may selectively open and close the bottom edge releasable fasteners to adjust how close fitting the garment is to the user's body. A tighter fit provides more protection against the elements while a looser fit enables more freedom of movement and increased ventilation. The releasable fasteners may be in the form of snaps, for example.

The rain garment may further include an integrally formed hood such that there are no seams where water may pass through the garment. The hood may include a plurality of adjustable, releasable fasters allowing a user to fold the front edge of the hood back upon itself to provide a greater viewing area for the user. Each releasable fastener on the hood is adjustable so that the user can adjust how far back the front edge of the hood is folded back and also adjust one fastener to a different degree than another fastener, if desired. As discussed above, the user may wish to fold back the front edge of the hood when hitting a golf ball. Since each fastener is individually adjustable, the user may fold back a larger segment of the hood along the side facing the hole while a smaller segment of the hood is folded back and secured on the side facing away from the hole. After the ball is hit, the golfer may release the hood fasteners and unfold the entire hood front edge to provide more coverage and rain protection for the face while the golfer is walking to the location of the hit ball, for example. The hood also preferably includes a drawstring to provide adjustable coverage beneath the chin area. In the preferred embodiment, the front and rear panels and hood are formed from a single (unitary) piece of fabric.

In yet a further embodiment, the rain garment may include a pocket located on the user's body-facing side of the front and/or rear panels to hold personal items such as a cell phone and keys, for example.

The garment front panel may further include an opening extending from about the middle torso area up to and optionally including the lower opposite side panels of the hood. The opening may include an adjustable closure such as a zipper, snaps, buttons, or VELCRO, for example. The opening may further include an inner panel that spans and closes off the opening to provide a barrier to the elements in this location when the adjustable closure is opened. In a preferred embodiment, the panel seams are heat sealed along the thread holes to prevent moisture from entering through this area.

DESCRIPTION OF THE DRAWING FIGURES

The above-mentioned and other features and advantages of this invention, and the manner of attaining them, will become apparent and be better understood by reference to the following description of the invention in conjunction with the accompanying drawing, wherein.

DETAILED DESCRIPTION OF A PREFERRED EMBODIMENT

Figure 1:
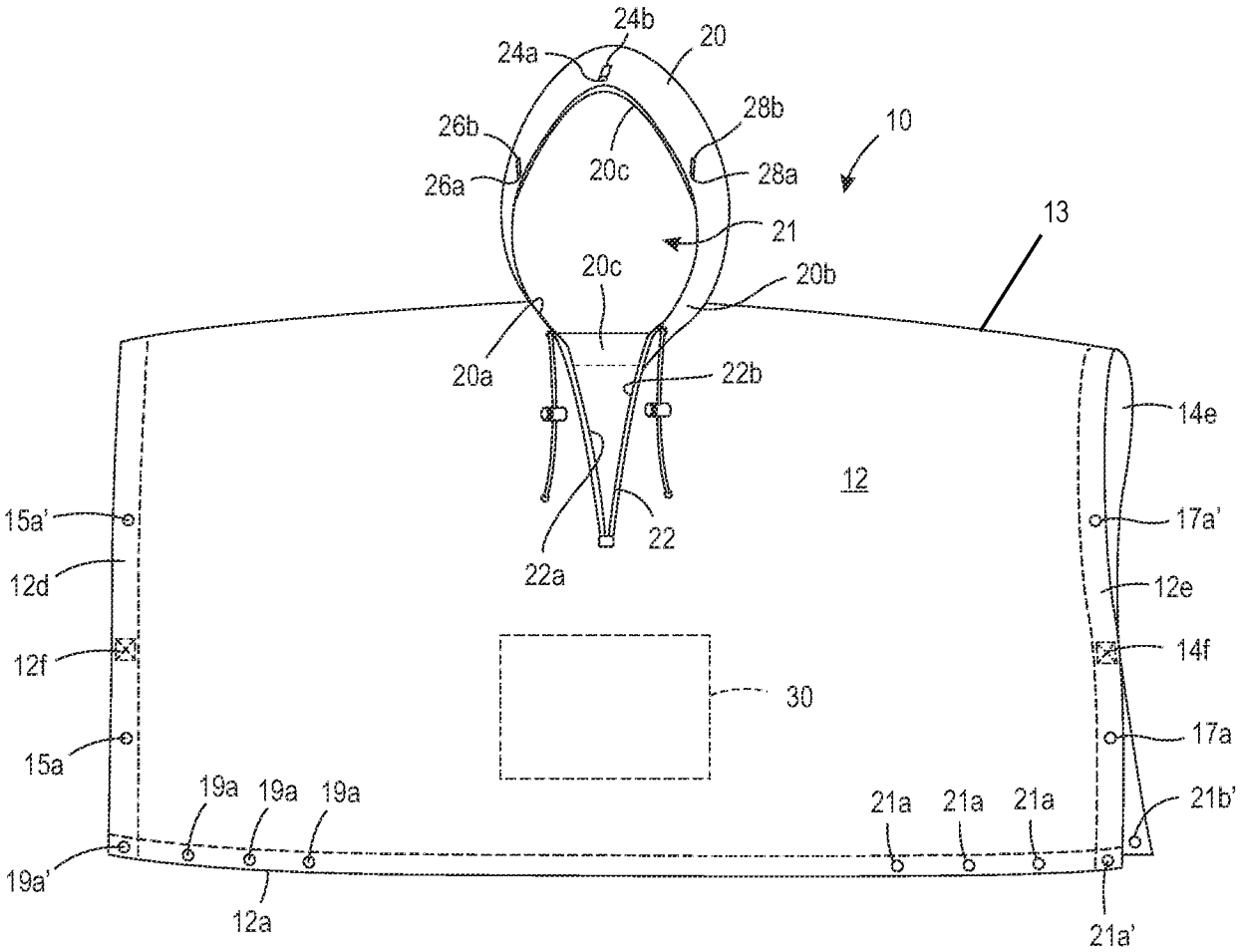
FIG. 1 is a front perspective view of an embodiment of the invention.
Figure 2:
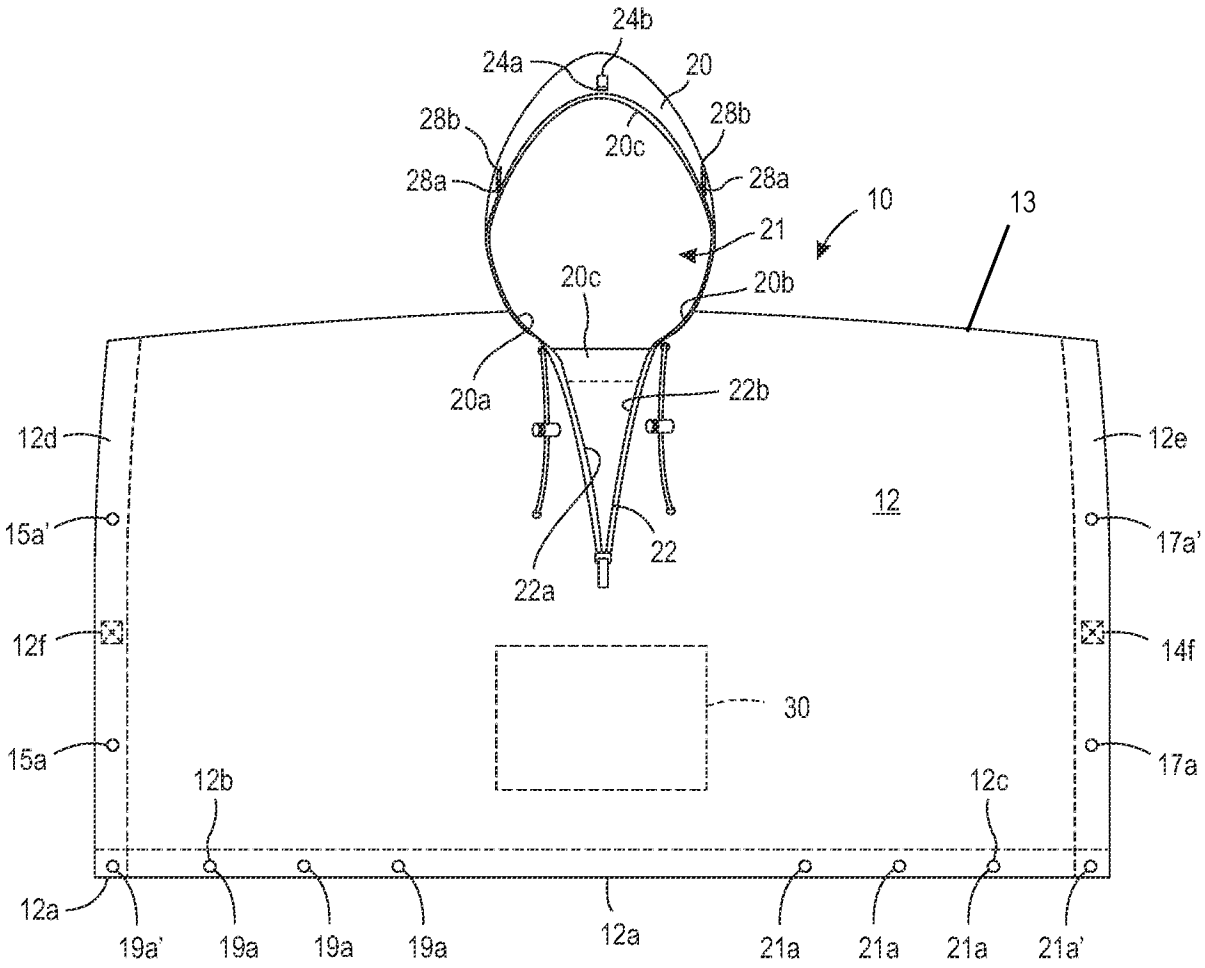
FIG. 2 is a front elevational view thereof.
Figure 3:
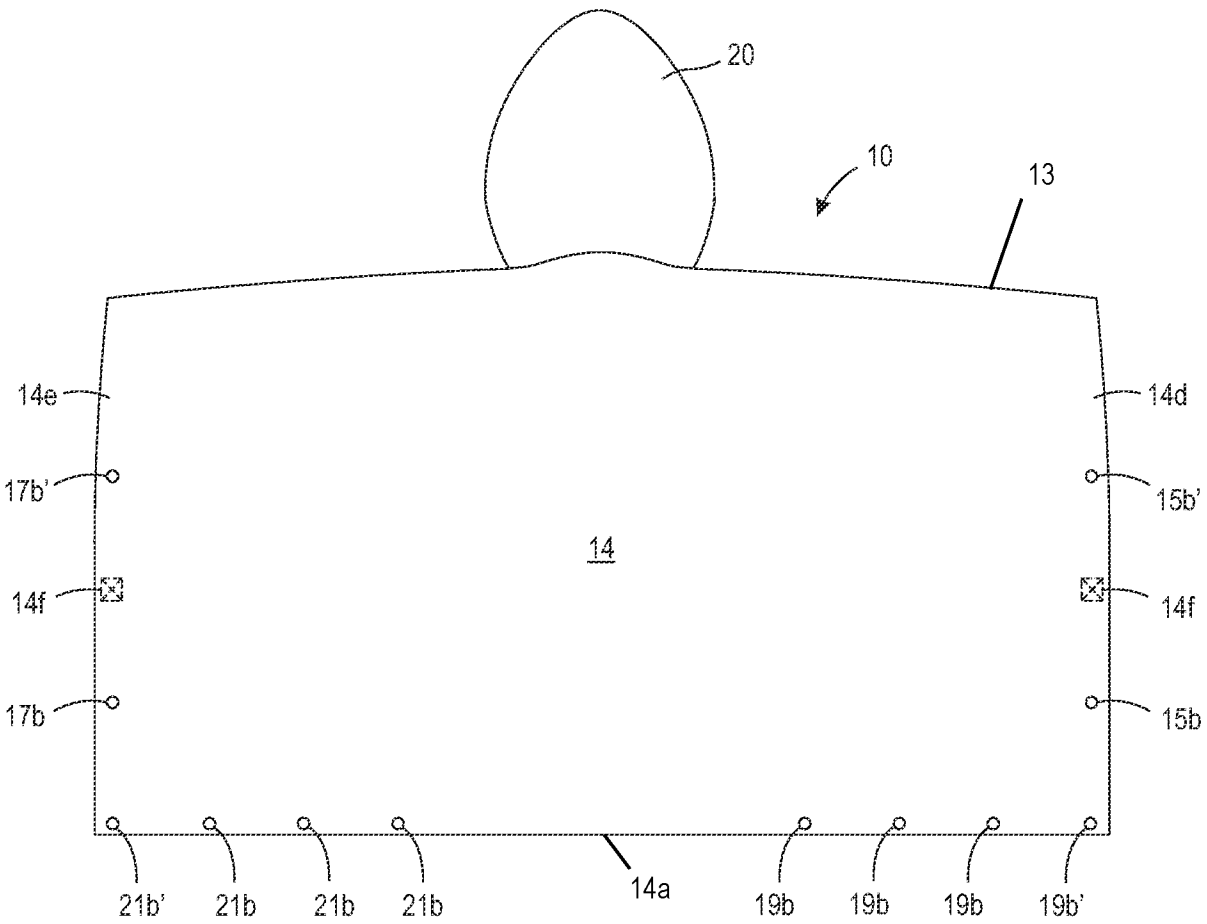
FIG. 3 is a rear elevational view thereof.
Figure 4:
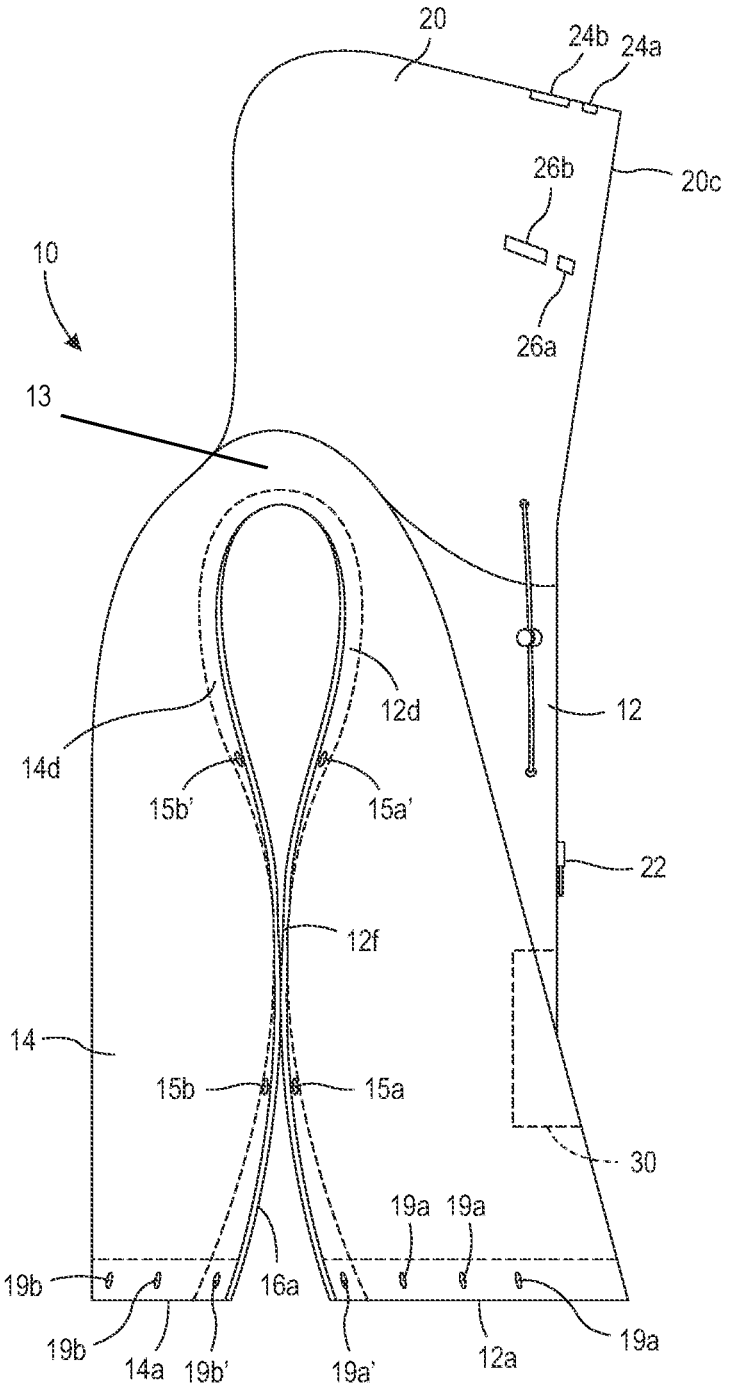
FIG. 4 is a right side elevational view thereof.
Figure 5:
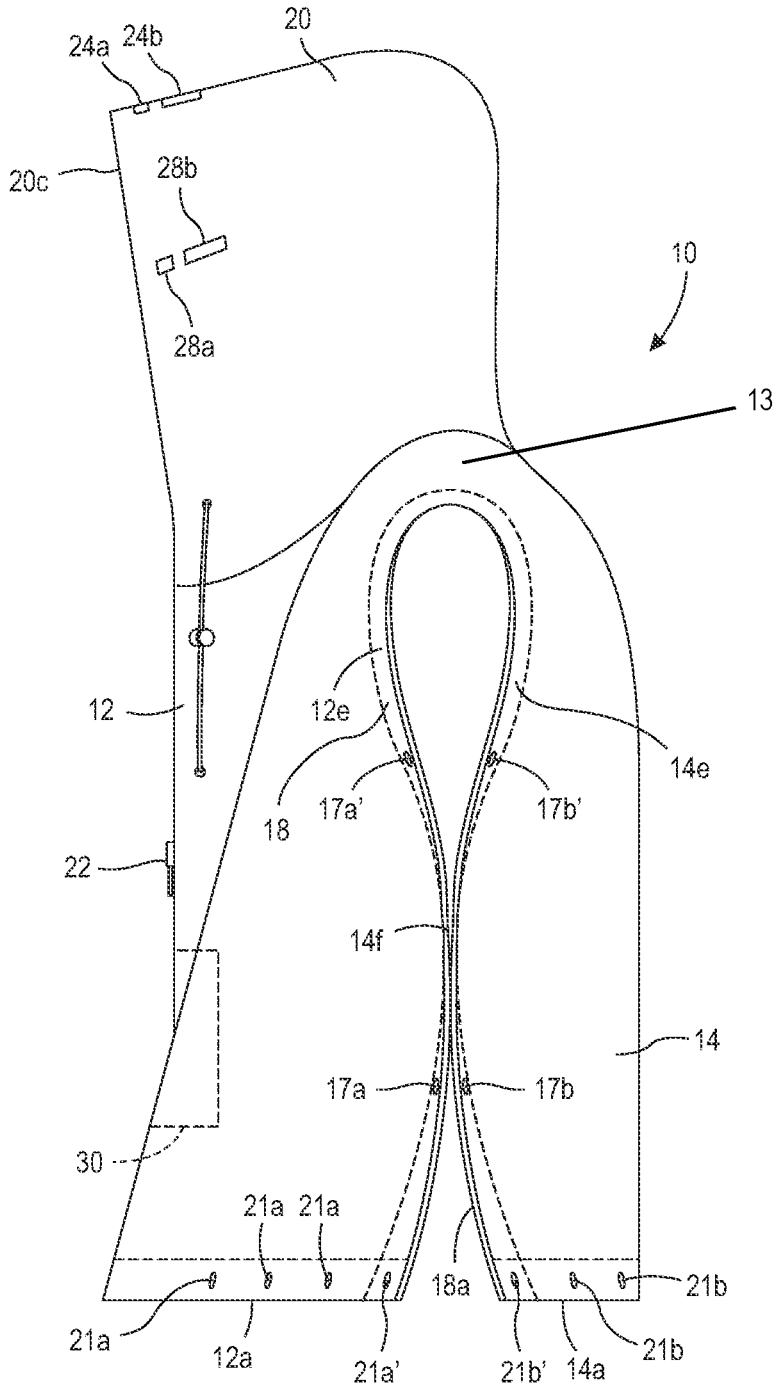
FIG. 5 is a left side elevational view thereof.
Figure 6:
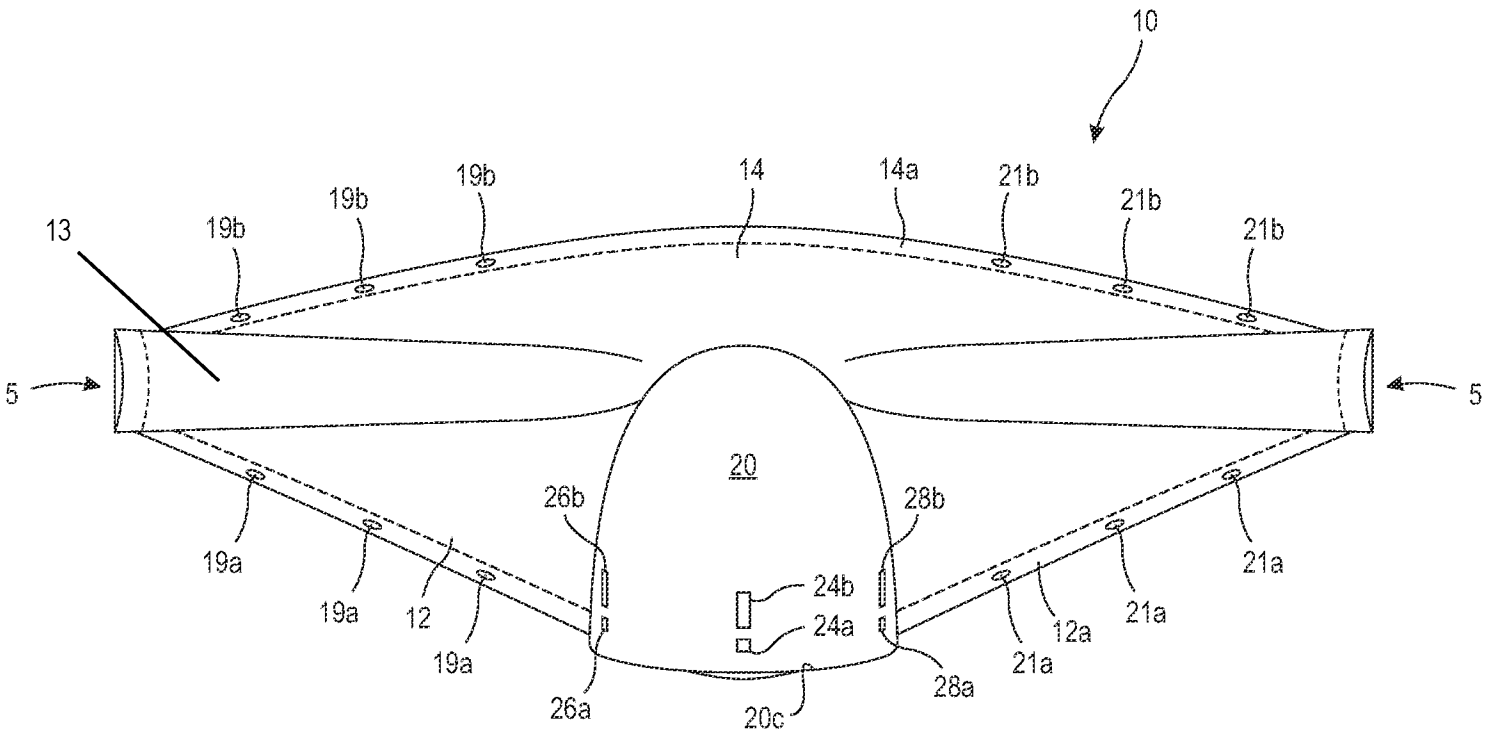
FIG. 6 is a top plan view thereof.
Figure 7:
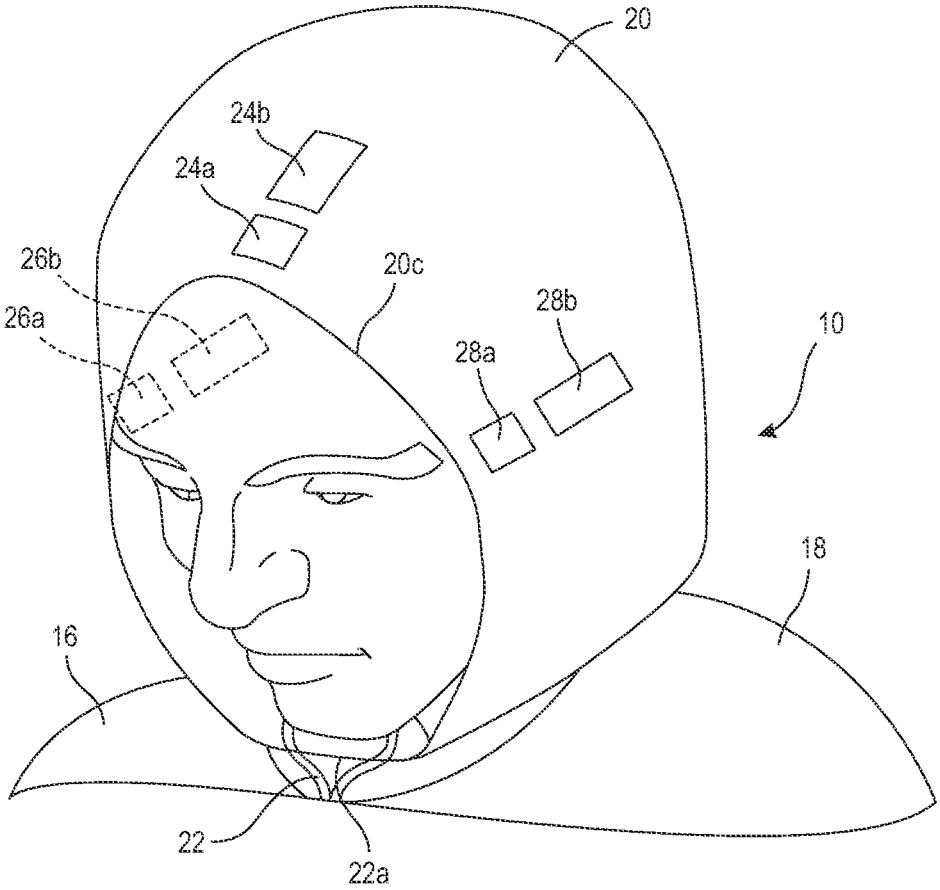
FIG. 7 is a partial front, perspective view showing the hood thereof in the unfolded condition on the head of a user.

Referring to the drawing, there is seen an embodiment of the invention in the form of a rain garment 10. The major portion of garment 10 is preferably, but not necessarily, formed from a single piece of fabric including a front panel 12 and a rear panel 14, respectively, and a hood 20 to form a head opening 21. As seen in FIGS. 1-6, the front panel 12 and the rear panel 14 extend from a shoulder fold 13 in the single piece of fabric to terminate at a front panel bottom free edge and a rear panel bottom free edge 12*a* and 14*a*, respectively. The fabric may be a water-resistant material but is more preferably a high performance, breathable, water-proof material such as GORE-TEX, for example. Although not shown, a water-proof liner may be optionally provided to increase the water-proof rating of a garment made from a material that is otherwise not 100% waterproof. The liner may be removably attachable to the inwardly facing surface of the garment 10 when a drenching and/or freezing rain is expected, for example. This liner (or an additional liner) may be made of fleece, wool or other material to add warmth to the user.

The garment 10 may be offered as a "one size fits all" and/or in a variety of different overall sizes (e.g., child, adult, women's, men's, small, medium, large, extra-large, etc.). The lower edges 12*a* and 14*a* of the front and rear panels 12 and 14, respectively, of each size may also be offered at a variety of different lengths such that a user may select their desired garment length (e.g., short, medium and long) extending anywhere from the user's upper torso down to the waist, hips or knees, for example. The front panel 12 may also be of the same or different length as the rear panel 14. The lower edge of the garment may be of any desired shape (e.g., straight, curved, etc.). In the embodiment of FIGS. 1-10, the front and rear panels form a rectangle when laid flat as seen best in FIGS. 1-3.

Referring to FIGS. 1-7, the front panel opposite side edges 12*d*, 12*e* are each fixedly attached to the respective opposite rear panel side edges 14*d*, 14*e* at a single point labeled 12*f* and 14*f*, respectively, via sewing (as shown) or via a permanent adhesive or heat sealing, for example. Cooperative releasable fasteners 15*a*', 15*b*' and 17*a*', 17*b*' (e.g., snaps, as shown) are provided on the front and rear panels 12, 14, respectively, above fixed connection points 12*f* and 14*f* (toward the user's shoulders) adjacent front and rear panel side edges 12*d*, 12*e*, and 14*d*, 14*e*, respectively. Cooperative releasable fasteners 15*a*, 15*b* and 17*a*, 17*b* are provided on the front and rear panels below each fixed connection point 12*f* and 14*f* (towards the user's waist) adjacent front and rear panel side edges 12*d*, 12*e*, and 14*d*, 14*e*, respectively.

When it is desired to put on or take off garment 10, the user may release fasteners 15*a*', 15*b*' and 17*a*', 17*b*' above fixed connection points 12*f*, 14*f* which allows a larger opening "S" for passage of the user's arms therethrough (see also FIG. 10). When the user desires to have a closer fit around the arms, they simply join the fasteners 15*a*' and 15*b*' located above fixed connection point 12*f* adjacent side edges 12*d*, 12*e*, respectively, and join fasteners 17*a*' and 17*b*' located above fixed connection point 14*f* adjacent side edges 14*e*, 14*d*. If the user desires to close the garment along the sides below the fixed connection points 12*f*, 14*f*, they simply fasten the fasteners 15*a*, 15*b* located below the fixed connection point 12*f* adjacent side edges 12*d*, 12*d*, respectively, and join fasteners 17*a* and 17*b* located above fixed connection point 14*f* adjacent side edges 14*e*, 14*d*.

As seen in FIG. 10, releasable sleeve fasteners 15*a*', 15*b*' located above fixed connection point 12*f* are unfastened with the user's arm "A" extending through the enlarged sleeve opening "S". The size or area of sleeve opening "S" is the inside diameter of that portion of the side panel that surrounds the user's arm and this sleeve size/area "S" is adjustable. As such, the user may form a large, loose sleeve area "S" as seen in FIG. 10 which allows for complete free movement of the user's arms "A" which may be desired when performing a task such as a golf swing, for example. The user may selectively fasten the fasteners 15*a*', 15*b*' and 17*a*', 17*b*' above the fixed connection points 12*f*, 14*f*, respectively, to provide a closer fit around the arms. Likewise, the user may fasten the fasteners 15*a*, 15*b* and 17*a*, 17*b* located below the fixed connection points to close this area of the garment when desired.

Cooperative releasable fasteners 19*a*', 19*b*' and 21*a*', 21*b*' are provided at the opposite corners of the front and rear panels, respectively, with one or more cooperative fasteners 19*a*, 19*b* and 21*a*, 21*b* positioned in spaced relation along the bottom edges 12*a* and 14*a* of the front and rear panels, respectively. It will be appreciated that the provision of multiple, spaced fasteners 19*a*, 19*b* and 21*a*, 21*b* allow the user to selectively adjust the opening about the torso from a very loose fit (all fasteners unfastened), to a very close fit (all fasteners fastened). A looser fit may be desired when swinging the golf club, for example, and a closer fit may be desirable when walking in the rain and/or cold, for example.

A zipper 22 may be provided on front panel 12 extending from approximately the middle thereof up to and including the side panels 20*a* and 20*b* which form part of hood 20. An inner panel 22*c* may be provided which spans and closes off the area between the mating zipper side lengths 22*a* and 22*b* to provide a barrier to the elements in this location when the zipper 22 is opened. In a preferred embodiment, the seams securing the panel 20*c* to the zipper lengths 22*a*, 22*b* are heat sealed at the thread holes to prevent moisture from entering through this area. The zipper 22 is also preferably waterproof. Opening zipper 22 provides increased venting along the front should the wearer become overly heated and also aids in accommodating large head sizes and headgear equipment, for example.

Figure 8:
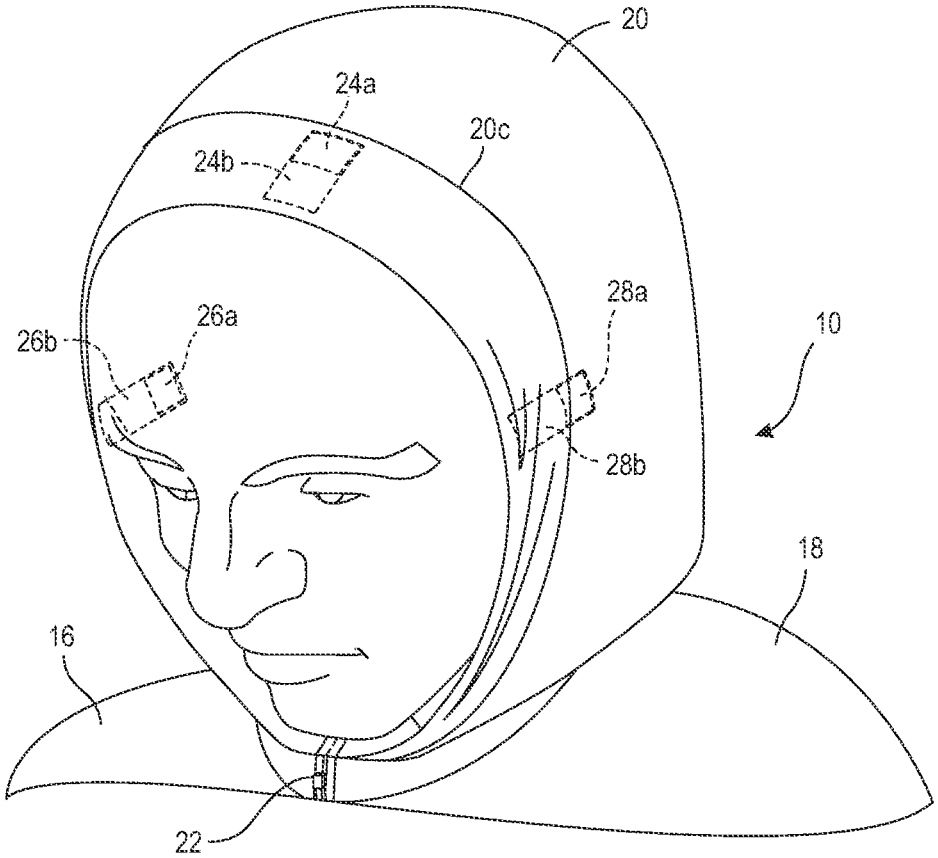
FIG. 8 is the view of FIG. 7 showing the hood thereof in the folded back condition on the head of a user.
Figure 9:
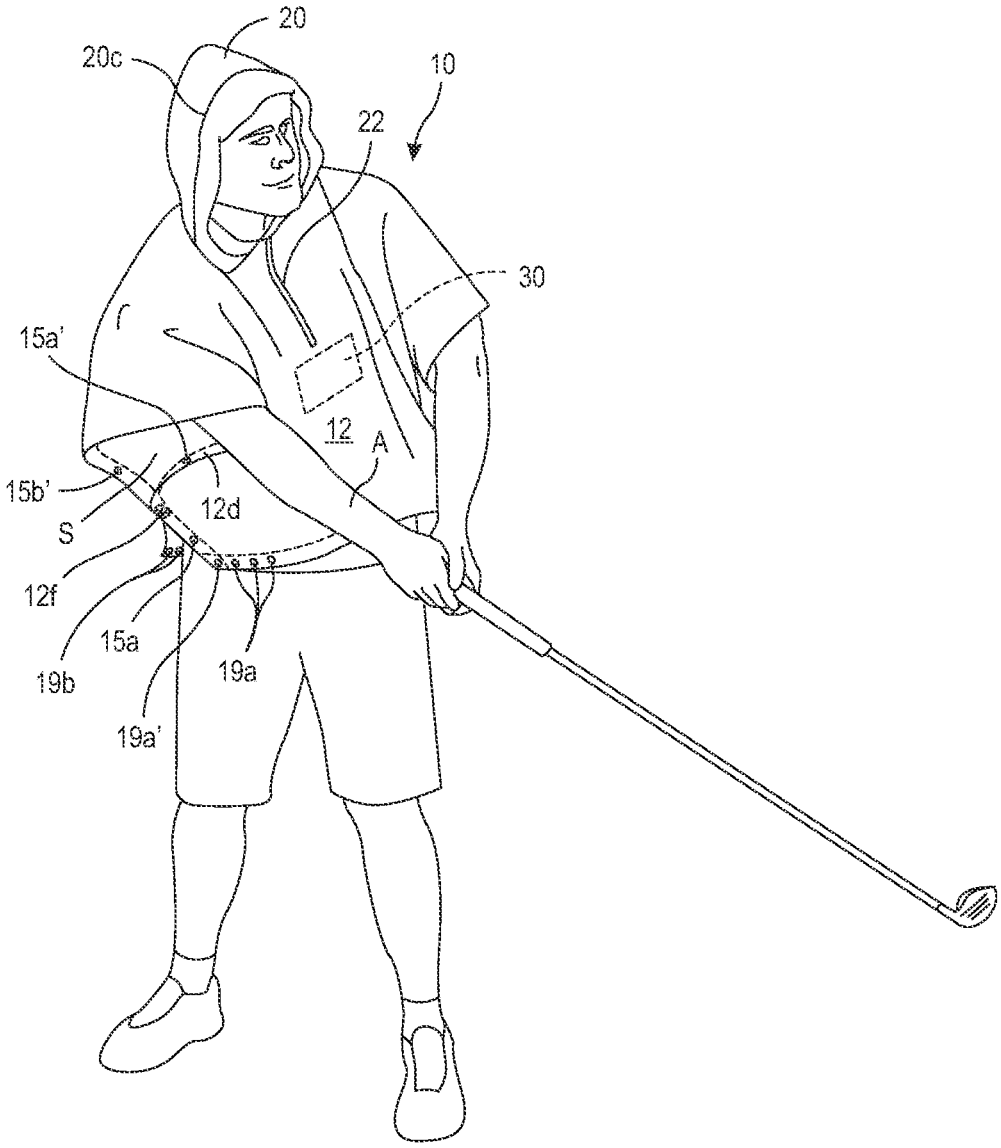
FIG. 9 is a front perspective view thereof with a golfer wearing the invention and in the middle of a golf swing.

As seen best in FIGS. 8 and 9, at least one, but preferably three pairs of releasable hood fasteners 24*a*, 24*b*; 26*a*, 26*b*; and 28*a*, 28*b* are provided adjacent the hood front edge 20*c*. First releasable hood fastener pair 24*a*, 24*b* may be located adjacent the top of the head/hood 20 and third releasable hood fastener pair 26*a*, 26*b*, and fourth releasable hood fastener pair 28*a*, 28*b* may be positioned adjacent the temple areas of the head when a user dons the hood 20, respectively. The releasable hood fasteners 24*a*, 24*b*; 26*a*, 26*b*; and 28*a*, 28*b* may be of any desired type although in the preferred embodiment they are hook and loop fabric strips such as VELCRO. The releasable hood fasteners closest to hood front edge 20*a* are labeled 24*a*, 26*a* and 28*a* and may by relatively short in length compared to their mating releasable hood fasteners 24*b*, 26*b* and 28*b*, respectively. This allows the user to fold the hood front edge 20*c* rearward upon itself (toward the back of the head) and apply the short releasable hood fasteners 24*a*, 26*a* and 28*a* at any location along the lengths of their mating releasable hood fasteners 24*b*, 26*b* and 28*b*, respectively. This allows the user to select and vary how far back the hood front edge 20*c* is folded back and thus allows the user to selectively vary and adjust where the leading edge of the hood facial opening comes to rest upon the user's head. The more forward the leading edge lies on the head, the more of the head is protected from the elements. This may be desirable when walking in rain, for example, where unobstructed lateral views are not required. When unobstructed lateral viewing is desired (e.g., when swinging a golf club), the user simply folds back the hood leading edge 20*c* which aligns and allows the user to secure the releasable hood fasteners 24*a*, 26*a* and 28*a* to their mating releasable hood fasteners 24*b*, 26*b* and 28*b*, respectively (see FIGS. 9 and 10). Once finished with the task (e.g., golf swing), the user may simply release each pair of releasable hood fasteners to unfold the hood and provide greater head coverage against the elements (see FIG. 8). It is also envisioned that a user may use a single fastener pair or any combination of fastener pairs, as desired.

As seen in FIGS. 1, 2, 4, 5 and 10, a pocket 30 may be provided on the surface of front panel 12 facing the user's body to secure and protect items from the elements (e.g., keys, phone, etc.). The pocket 30 may include a closure such as a zipper, for example. Additional pockets may be provided on the interior or exterior of front and rear panels 12 and 14 as desired.

Garment 10 may be made of any type of material which provides the desired amount of protection from the elements. In one preferred embodiment, the material is a high performance, water proof, breathable material such as GORE-TEX, for example.

While the invention has been shown and described with reference to certain preferred embodiments thereof, it will be understood by those skilled in the art that various changes in form and details may be made therein without departing from the spirit and scope of the invention as described.

What is claimed is:

1. A garment comprising:

a unitary front panel, rear panel, and hood, the hood having interior and exterior surfaces and defining an opening between the front and rear panels configured for a user's head to pass therethrough, the front and rear panels extending from a shoulder fold to terminate at a front panel bottom free edge and a rear panel bottom free edge, respectively, the front panel having opposite front panel side edges extending from the shoulder fold to the front panel bottom free edge and the rear panel having opposite rear panel side edges extending from the shoulder fold to the rear panel bottom free edge, the front and rear panels being permanently fixed together at first and second permanent connection points adjacent the opposite front panel side edges and the opposite rear panel side edge, respectively and thereby forming first and second sleeve openings between the front and rear panels and the first and second permanent connection points, respectively, the first and second permanent connection points being intermediate the shoulder fold and the front panel bottom free edge and the rear panel bottom free edge; the hood being configured to be adjustable and having a leading edge that is foldable outwardly from a first position to a second position such that a first section of the exterior surface of the hood fastens to a second section of the exterior surface of the hood when in the second position, the front panel and the rear panel including cooperative releasable fasteners adjacent the opposite front panel side edges and the opposite rear panel side edges, the cooperative releasable fasteners further being intermediate the permanent connection points and the front panel bottom free edge and the rear panel bottom edge, the releasable fasteners configured to selectively open and engage the front and rear panels below the first and second permanent connection points; and a first adjustable releasable fastener pair attached to the exterior surface of the hood, the first adjustable releasable fastener pair being configured to secure the leading edge of the hood in the second position to provide unobstructed lateral viewing by the user of the garment, the first adjustable releasable fastener pair being configured to variably secure the leading edge of the hood in the adjustable second position between a front side and a back side of the hood.

2. The garment of claim 1, further comprising:

first and second releasable fasteners attached to the front and rear panels above the first and second permanent connection points, respectively, the first and second releasable fasteners being configured to selectively adjust a cross-sectional area of the garment about the user's arms.

3. The garment of claim 1, further comprising releasable fasteners along the front panel bottom free edge and the rear panel bottom free edge.

4. The garment of claim 1, further comprising a plurality of releasable fasteners in linear spaced relation adjacent to bottom edges of the front and rear panels, the plurality of releasable fasteners being configured to selectively adjust the fit of the garment about the user's torso.

5. The garment of claim 1, further comprising second and third adjustable releasable fastener pairs attached to the exterior surface of the hood whereby the leading edge is foldable outwardly back upon itself which aligns and allows the second and third adjustable releasable fastener pairs to be releasably fastened together, respectively, the second and third adjustable releasable fastener pairs being configured to secure the leading edge in the folded position to provide unobstructed lateral viewing for the user of the garment.

6. The garment of claim 5, wherein the hood has a top and opposite first and second temple areas and the first adjustable releasable fastener pair is located adjacent the top of the hood and the second and third adjustable releasable fastener pairs are located adjacent the first and second temple areas of the hood, respectively.

7. The garment of claim 1, further comprising a pocket configured to be affixed to an inner surface of the front panel which faces the user.

8. The garment of claim 1, further comprising a zipper affixed to the front panel, the zipper including two series of opposed teeth.

9. The garment of claim 8, further comprising a panel spanning between the two series of opposed teeth of the zipper.

10. The garment of claim 1, wherein the front and rear panels and the hood are formed from a single piece of a water-proof, breathable material.

11. A garment comprising:

a unitary front panel, rear panel, and hood, the hood having interior and exterior surfaces and defining an opening between the front and rear panels configured for a user's head to pass therethrough, the front and rear panels extending from a shoulder fold to terminate at a front panel bottom free edge and a rear panel bottom free edge, respectively, the front panel having opposite front panel side edges extending from the shoulder fold to the front panel bottom free edge and the rear panel having opposite rear panel side edges extending from the shoulder fold to the rear panel bottom free edge, the front and rear panels being permanently fixed together at first and second permanent connection points adjacent the opposite front panel side edges and the opposite rear panel side edge, respectively and intermediate the shoulder fold and the front panel bottom free edge and the rear panel bottom free edge and thereby forming first and second sleeve openings between the front and rear panels at the shoulder fold and the first and second permanent connection points, respectively, the front panel and the rear panel including cooperative releasable fasteners adjacent the opposite front panel side edges and the opposite rear panel side edges, the cooperative releasable fasteners further being intermediate the permanent connection points and the front panel bottom free edge and the rear panel bottom edge and configured to releasably engage the front panel side edge and the rear panel side edge; and a plurality of releasable fasteners located along each of the front panel bottom free edge and the rear panel bottom free edge, the plurality of releasable fasteners configured to releasably engage the front panel and the rear panel.

12. The garment of claim 11, wherein the hood is configured to be adjustable and has a leading edge that is foldable outwardly from a first position to a second position such that a first section of the exterior surface of the hood fastens to a second section of the exterior surface of the hood when in the second position; and the garment further comprising:

first and second releasable fasteners attached to the front and rear panels above the first and second permanent connection points, respectively, the first and second releasable fasteners being configured to selectively adjust a cross-sectional area of the garment about the user's arms; and a first adjustable releasable fastener pair attached to the exterior surface of the hood, the first adjustable releasable fastener pair being configured to secure the leading edge of the hood in the second position to provide unobstructed lateral viewing by the user of the garment, the first adjustable releasable fastener pair being configured to variably secure the leading edge of the hood in the adjustable second position between a front side and a back side of the hood.

13. The garment of claim 12, further comprising second and third adjustable releasable fastener pairs attached to the hood whereby the leading edge is foldable back upon itself which aligns and allows the second and third adjustable releasable fastener pairs to be releasably fastened together, respectively, the second and third adjustable releasable fastener pairs being configured to secure the leading edge in the folded position to provide unobstructed lateral viewing for the user of the garment.

14. The garment of claim 13, wherein the hood has a top and opposite first and second temple areas and the first adjustable releasable fastener pair is located adjacent the top of the hood and the second and third adjustable releasable fastener pairs are located adjacent the first and second temple areas of the hood, respectively.

15. The garment of claim 11, further comprising releasable fasteners along the front panel bottom free edge and the rear panel bottom free edge.

16. The garment of claim 11, further comprising a plurality of releasable fasteners in linear spaced relation adjacent to bottom edges of the front and rear panels, the plurality of releasable fasteners being configured to selectively adjust the fit of the garment about the user's torso.

17. The garment of claim 11, further comprising a pocket on an inner surface of the front panel which faces the user.

18. The garment of claim 11, further comprising a zipper affixed to the front panel, the zipper including two series of opposed teeth.

19. The garment of claim 18, further comprising a panel spanning between the two series of opposed teeth of the zipper.

20. The garment of claim 11, wherein the front and rear panels and the hood are formed from a water-proof, breathable material.

* * * * *